US005128685A

United States Patent [19]

Shinnai et al.

[11] Patent Number: 5,128,685

[45] Date of Patent: Jul. 7, 1992

[54] WIDE-BAND ANTENNA ON VEHICLE ROOF GLASS

[75] Inventors: Masao Shinnai; Kazuya Nishikawa; Tokio Tsukada; Tohru Hiroysu, all of Matsusaka, Japan

[73] Assignee: Central Glass Company, Limited, Ube, Japan

[21] Appl. No.: 527,880

[22] Filed: May 24, 1990

[30] Foreign Application Priority Data

May 30, 1989 [JP] Japan ..... 1-136986

[51] Int. Cl.[5] ..... H01Q 1/32

[52] U.S. Cl. ..... 343/713

[58] Field of Search ..... 343/711-713, 343/704

[56] References Cited

U.S. PATENT DOCUMENTS

| | | | |
|---|---|---|---|
| 4,608,570 | 8/1986 | Inaba et al. | 343/713 |
| 4,727,377 | 2/1988 | Yotsuya et al. | 343/713 |
| 4,768,037 | 8/1988 | Inaba et al. | 343/713 |
| 4,791,426 | 12/1988 | Lindenmeier et al. | 343/713 |
| 4,849,766 | 7/1989 | Inaba et al. | 343/713 |

FOREIGN PATENT DOCUMENTS

| | | | |
|---|---|---|---|
| 2136759 | 3/1973 | Fed. Rep. of Germany | 343/713 |
| 2166231 | 6/1973 | Fed. Rep. of Germany | 343/713 |
| 140301 | 11/1980 | Japan | 343/713 |
| 150602 | 11/1980 | Japan | 343/713 |
| 24802 | 3/1981 | Japan | 343/713 |
| 196605 | 11/1984 | Japan | 343/713 |
| 81101 | 4/1987 | Japan . | |
| 130402 | 6/1987 | Japan . | |
| 292702 | 11/1988 | Japan . | |

*Primary Examiner*—Michael C. Wimer

*Attorney, Agent, or Firm*—Fleit, Jacobson, Cohn, Price, Holman & Stern

[57] ABSTRACT

The invention relates to an antenna attached to a vehicle roof glass, i.e. a glass plate fitted in an opening of the roof of a vehicle body such as an automobile body, for receiving FM radio and TV broadcast waves in both the VHF band and the UHF band. Essentially the antenna is comprised of a main element which is a conductive strip attached to the roof glass and bent so as to make a closed plane figure, a feed point attached to the roof glass and a connection line which connects the main element to the feed point and extends parallel or nearly parallel to the longitudinal center axis of the vehicle body. The total length of the main element is from 200 to 1500 mm. For example, the main element makes a rectangle in a central region of the roof glass with two opposite sides of the rectangle parallel to the aforementioned center axis. Optionally the antenna may include an auxiliary element which is a conductive strip attached to the roof glass and connected to the feed point. For example, auxiliary element may be an angled segment which makes two or three sides of a rectangle.

11 Claims, 3 Drawing Sheets

WIDE-BAND ANTENNA ON VEHICLE ROOF GLASS

BACKGROUND OF THE INVENTION

This invention relates to an antenna provided to a vehicle roof glass, which means a glass plate fitted in an opening of a vehicle roof, for receiving FM radio and television (TV) broadcast waves. The principal element of the antenna is a conductive strip attached to the roof glass in a suitable pattern. The antenna is particularly suited to automobiles.

In recent automobiles there is an increasing trend to adoption of a "sun roof" or "sky roof" which means forming an opening in the roof of the car body and fitting a glass plate in the opening. In the present specification, that glass plate will be called a roof glass.

For the reception of radio and/or TV broadcast waves it is known to provide an automobile window glass with an antenna which is constructed of conductive strips printed on the window glass in a suitable pattern. Also it has been proposed to provide an antenna of a similar type to an automobile roof glass (e.g., JP-A (Utility Model) 56-22807). However, with automobile roof glass antennas proposed until now it is difficult to realize high reception gains over a wide range of frequencies including the FM bands for radio broadcasting and the VHF and UHF bands for TV broadcasting mainly because a roof antenna has to be constructed in a relatively narrow area.

SUMMARY OF THE INVENTION

It is an object of the invention to provide a vehicle roof glass antenna which is particularly suited to automobiles and functions as a wide-band antenna capable of receiving FM radio brodcast waves and TV broadcast waves in both the VHF band and the UHF band with sufficiently high gains.

The present invention provides an antenna attached to a vehicle roof glass for receiving broadcast waves, the antenna comprising a main antenna element which is a conductive strip attached to the glass plate and bent so as to make a closed plane figure and has a total length in the range from 200 to 1500 mm, a feed point attached to the glass plate, and a connection line which connects the main antenna element to the feed point and extends parallel or nearly parallel to the longitudinal center axis of the vehicle body.

In the present invention the main antenna element is in the shape of the perimeter of a closed plane figure. A preferred example of the closed plane figure is a rectangle, but the antenna can be made sufficiently high in efficiency also when the closed plane figure is a different quadrilateral such as a square or a rhombus, a still different polygon, a circle or an ellipse.

It is preferable to dispose the main antenna element in a central region of the roof glass, though this antenna element can be disposed in any region of the roof glass insofar as the distance of the antenna element from every edge of the roof glass is not shorter than 30 mm.

Also it is preferable to dispose the feed point and the connection line on or near the longitudinal center axis of the roof glass. In such an arrangement, the length of the connection line has little influence on the reception characteristics of the antenna. However, when the main antenna element is distant from the center axis the feed point and the connection line can be disposed distant from the center axis. Usually the feed point is positioned at a short distance from the front or rear edge of the roof glass, and the efficiency of the antenna does not significantly differ whether the feed point is near the front edge or near the rear edge.

A vehicle roof glass antenna according to the invention can be constructed in a relatively narrow area, and this antenna serves as a wide-band antenna which exhibits sufficiently high gains in receiving FM radio broadcast waves, of both the 76-90 MHz band used in Japan and the 88-108 MHz used in many other countries, and TV broadcast waves of both the VHF band and the UHF band. This invention is very suitable for application to automobiles.

To further augment the reception gains of an antenna according to the invention it is optional to supplement the main antenna element with an auxiliary antenna element which is a conductive strip connected to the feed point by direct connection with the main antenna element or by connection with the aforementioned connection line. The auxiliary element may be either straight or bent, for example, so as to make a portion of the perimeter of a rectangle. To gain the favorable effect of the auxiliary element, this element is designed so as to adjust the resistance and reactance of the antenna for the sake of impedance matching of the antenna with the feeder.

DESCRIPTION OF THE PREFERRED EMBODIMENTS

Figure 1:
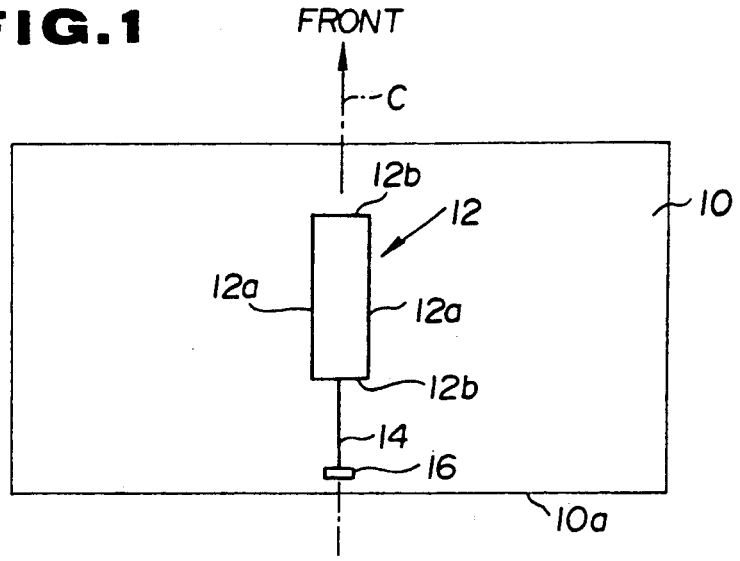
FIG. 1 is a plan view of an automobile roof glass antenna as an embodiment of the invention.

FIG. 1 shows an embodiment of the invention in an automobile roof glass. A single piece of glass plate 10 is used as the roof glass. An antenna of the following construction is disposed on the inboard surface of the roof glass 10.

The antenna has a main antenna element 12 which is a conductive strip formed by printing a conductive paste onto the glass surface and, after drying, baking the glass plate 10 with the printed paste thereon. The main element 12 of the antenna is positioned in a central region of the roof glass 10, and this element 12 is in the shape of the perimeter of a rectangle with its longer sides **12*a* parallel to the longitudinal center axis C of the car body and its shorter sides 12*b* intersecting the axis C. From one of the shorter sides 12*b* of the rectangle a connection line 14 extends to a feed point 16 which is disposed at a short distance from the rear edge 10*a* of the roof glass 10. The longitudinal center axis of the rectangular element 12 is common to the center axis C of the car body, and the connection line 14 and the feed point 16 are on the center axis C. The connection line 14 and the feed point 16** are provided on the glass surface by the aforementioned print-and-bake method.

EXAMPLE 1

An automobile roof glass antenna of the construction and arrangement shown in FIG. 1 was produced with the following dimensions.

The roof glass 10 was 580 mm in width perpendicular to the center axis C and 320 mm in length. The rectangular main antenna element 12 was 50 mm in width (length of shorter sides 12*b*) and 150 mm in length (length of longer sides 12*a*) and, hence, had a total length of 400 mm. The connection line 14 had a length of 100 mm, and the feed point 16 was at a distance of 20 mm from the rear edge 10*a* of the roof glass.

Gains of the antenna of Example 1 in receiving FM radio broadcast waves and TV broadcast waves (horizontally polarized waves) were measured and compared with gains of a standard dipole antenna. That is, for any given frequency the gain of the dipole antenna was taken as the basis, 0 dB, and the gain of the sample antenna was marked on this basis. As the result, reception gain of the antenna of Example 1 was −19.5 dB on an average in the Japanese domestic FM radio broadcasting band of 76–90 MHz, −18.8 dB on an average in the foreign FM broadcasting band of 88–108 MHz, −18.2 dB on an average in the VHF TV broadcasting band of 90–222 MHz and −16.3 dB on an average in the UHF TV broadcasting band of 470–770 MHz. For comparison, by the same testing a good example of conventional automobile rear window glass antennas exhibited an average gain (vs. dipole antenna) of about −21 dB in either of the two FM radio broadcasting bands and about −20 dB in either of the VHF and UHF TV broadcasting bands. Therefore, the roof glass antenna of FIG. 1 is judged to be a very good wide-band antenna for receiving FM radio and TV broadcast waves.

To confirm the dependence of the efficiency of the antenna of FIG. 1 on the total length of the rectangular element 12, the antenna of Example 1 was modified by variously decreasing and increasing the total length of the element 12. Average reception gains (vs. dipole antenna) of the modified antennas in the respective frequency bands were as shown in Table 1.

TABLE 1

| Total Length of Antenna Element (mm) | Average Gain (dB) | | | |
|---|---|---|---|---|
| | FM Radio | | TV | |
| | 76-90 MHz | 88-108 MHz | VHF | UHF |
| 100 | −26.3 | −24.7 | −25.4 | −22.4 |
| 150 | −23.7 | −21.9 | −22.3 | −19.8 |
| 200 | −20.1 | −19.2 | −18.8 | −17.0 |
| 400 | −19.5 | −18.8 | −18.2 | −16.3 |
| 700 | −19.3 | −19.6 | −19.3 | −17.6 |
| 1000 | −19.9 | −20.1 | −20.7 | −19.4 |
| 1300 | −20.3 | −20.7 | −21.1 | −20.8 |
| 1500 | −21.2 | −21.5 | −22.0 | −21.9 |
| 1700 | −23.8 | −22.9 | −24.3 | −22.8 |
| 2000 | −25.9 | −25.0 | −27.1 | −23.6 |
| 2300 | −28.4 | −27.7 | −29.2 | −24.3 |

The above test results indicate that the antenna of FIG. 1 realizes high receptin gains in any of the four bands when the total length of the rectangular element 12 is in the range from about 200 mm to about 1500 mm. In view of the above and other test results, in the present invention it is preferable that the total length of the main antenna element (12) falls in the range from 200 to 700 mm.

The following Examples 2 to 6 relates to the addition of an auxiliary antenna element, or two symmetrical auxiliary elements, to the roof glass antenna of Example 1. In every case there was no change in the size of the roof glass and the arrangement of the main antenna element 12, conncetion line 14 and feed point 16, and the total length of the rectangular main element 12 was constantly 400 mm.

EXAMPLE 2

Figure 2:
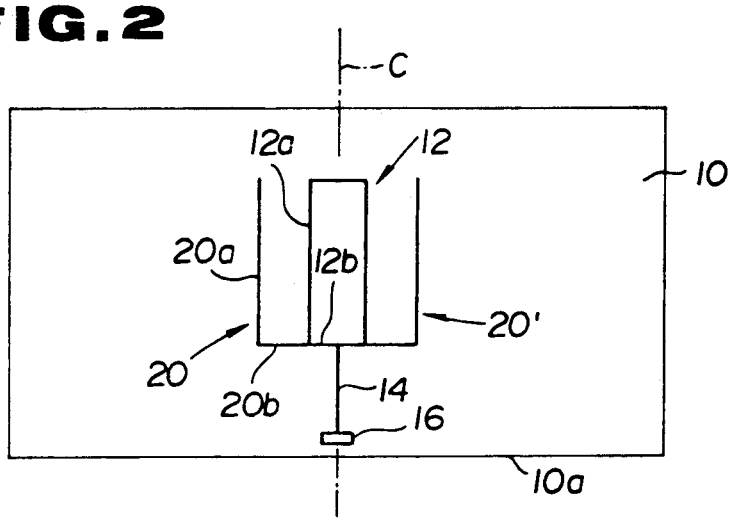
FIGS. 2 to 6 show five different modifications of the antenna of FIG. 1, respectively, each modification being the addition of at least one auxiliary antenna element.

FIG. 2 shows the antenna of Example 2. This antenna included two L-shaped auxiliary antenna elements 20 and 20' which were symmetrical with respect to the center axis C of the car body. Each of the L-shaped auxiliary elements 20, 20' had a longer leg 20*a* parallel to the longer sides 12*a* of the main element 12 and a shorter leg 20*b* which extended from a shorter side 12*b* of the main element 12. The longer leg 20*a* of each auxiliary element 20, 20' was 150 mm long, and the shorter leg 20*b* was 50 mm long.

EXAMPLE 3

Figure 3:
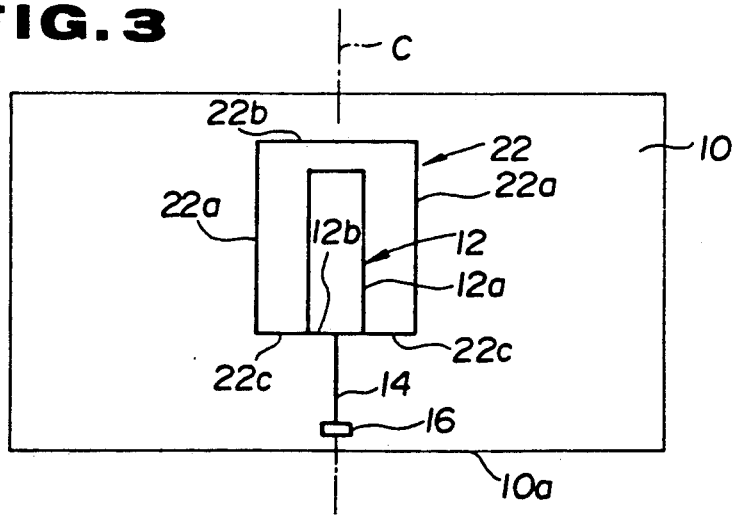

FIG. 3 shows the antenna of Example 3. This antenna included an auxiliary antenna element 22 which was a conductive strip bent so as to make a rectangle with a gap in one side thereof. That is, the auxiliary element 22 had two longitudinal segments 22*a* parallel to the longer sides 12*a* of the rectangular main element 12, a lateral segment 22*b* connecting the two longitudinal segments 22*a* to each other and two short lateral segments 22*c* each extending from a shorter side 12*b* of the main element 12 to one of the longitudinal segments 22*a*. The longitudinal center axis of the auxiliary element 22 was common to the longitudinal center axis of the main element 12. The longitudinal segments 22*a* were each 180 mm long; the lateral segment 22*b* was 150 mm long; and each of the short lateral segments 22*c* was 50 mm long.

EXAMPLE 4

Figure 4:
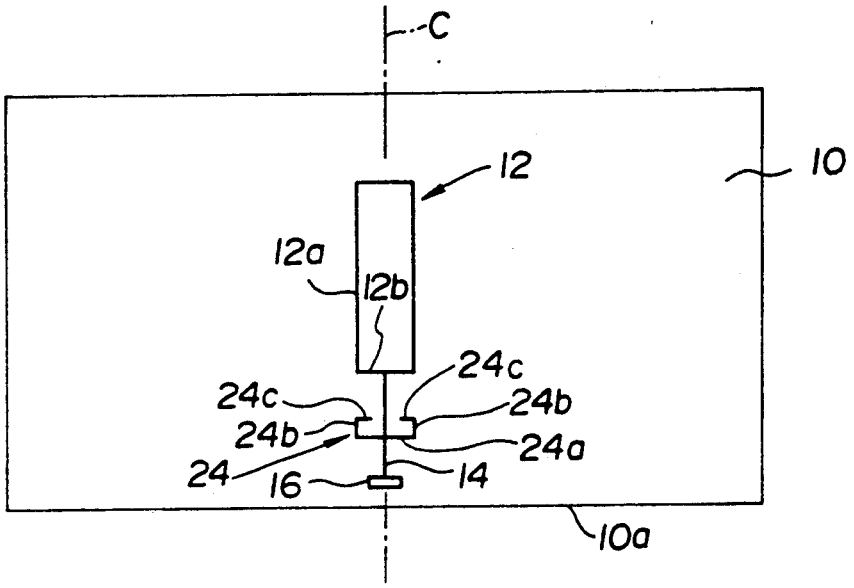

FIG. 4 shows the antenna of Example 4. This antenna included an auxiliary antenna element 24 which was a conductive strip bent so as to make a rectangle with a gap in its one side and disposed between the main element 12 and the feed point 16. That is, the auxiliary element 24 had a lateral segment 24*a* which extended parallel to the shorter sides 12*b* of the rectangular main element 12 and intersected the center axis C of the car body, two short longitudinal segments 24*b* respectively extending from the opposite ends of the lateral segment 24*a* toward the main element 12 and two short lateral segments 24*c* respectively extending from the ends of the two longitudinal segments 24*b* parallel to the lateral segment 24*a* toward the center axis C. The auxiliary element 24 was positioned so as to be bisected by the center axis C.

The lateral segment 24*a* of the auxiliary element 24 was 50 mm long; each of the longitudinal segments 24*b* was 25 mm long; and each of the short lateral segments 24*c* was 15 mm long.

EXAMPLE 5

Figure 5:
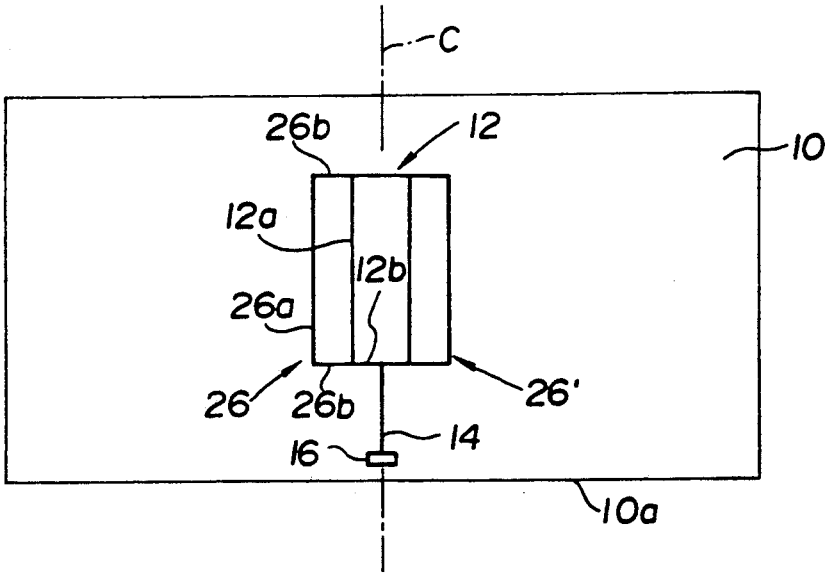

FIG. 5 shows the antenna of Example 5. This antenna included two auxiliary antenna elements 26 and 26' which were symmetrical with respect to the center axis C of the car body. Each auxiliary element 26, 26' was bent so as to make three sides of a rectangle. That is, each auxiliary element 26, 26' had a longitudinal segment 26*a* parallel to the longer sides 12*a* of the rectangular main element 12 and two lateral segments 26*b* extending from the two shorter sides 12b of the main element 12, respectively. The longitudinal segment 26a was 150 mm long, and each of the lateral segments 26b was 30 mm long.

EXAMPLE 6

Figure 6:
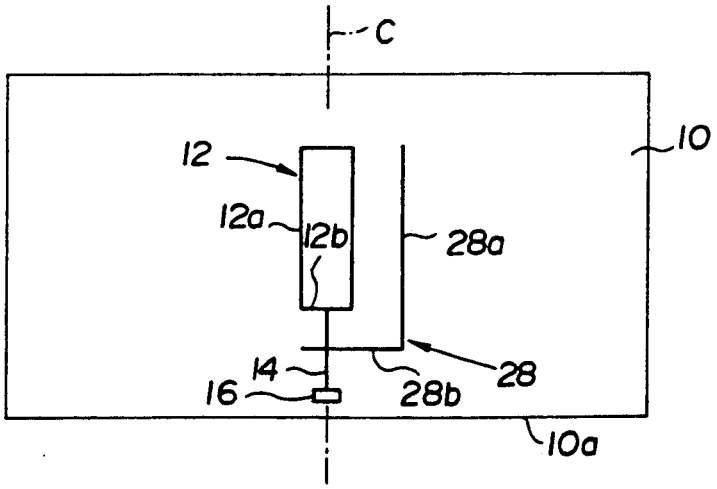

FIG. 6 shows the antenna of Example 6. This antenna included an L-shaped auxiliary antenna element 28 having a longer leg 28a parallel to the longer sides 12a of the main element 12 and a shorter leg 28b intersecting the connection line 14. The shorter side 28b was 100 mm long, and the longer leg 28a was 200 mm long and at a distance of 75 mm from the connection line 14.

EXAMPLE 7

Figure 7:
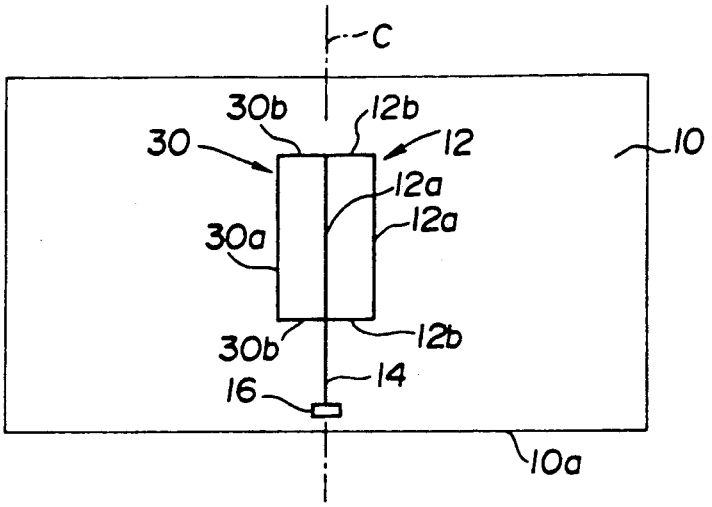
FIGS. 7 and 8 are plan views of two still differently arranged roof glass antennas according to the invention, respectively.

FIG. 7 shows the antenna of Example 7. In this antenna the position of the main element 12 in the antenna of Example 1 (FIG. 1) was slightly changed such that one of the longer sides 12a of the rectangular element 12 came on the center axis C of the car body. This antenna included an auxiliary antenna 30 which was bent so as to make three sides of a rectangle. The auxiliary element 30 had a longitudinal segment 30a parallel to the longer sides 12a of the main element 12 and two lateral segments 30b extending from the two shorter sides 12b of the main element 12, respectively. The longitudinal segment 30a was 150 mm long, and each of the lateral segments 30b was 50 mm long.

EXAMPLE 8

Figure 8:
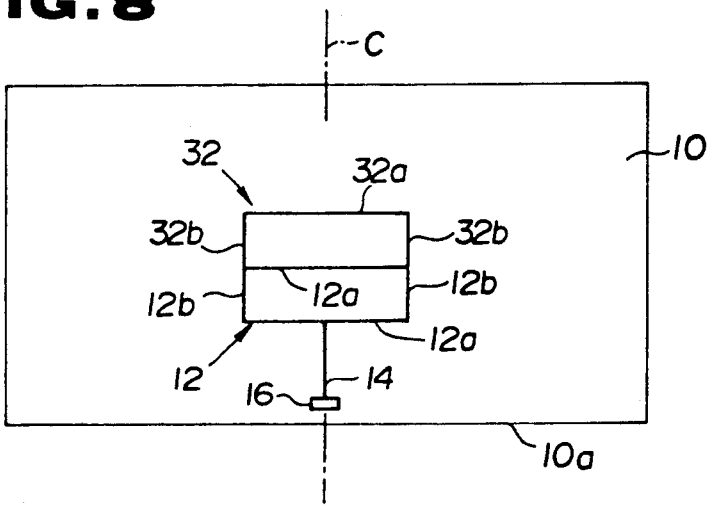

FIG. 8 shows the antenna of Example 8. In this antenna the rectangular main element 12 in the antenna of Example 1 was rotated by 90° so that the longer sides 12a of the main element 12 were bisected by the center axis C of the car body, and accordingly the conncection line 14 was extended from the middle of a longer side 12a of the main element 12. This antenna included an auxiliary antenna element 32 which was bent so as to make three sides of a rectangle. The auxiliary element 32 had a lateral segment 32a parallel to the longer sides 12a of the main element 12 and two longitudinal segments 32b extending from the two shorter sides 12b of the main element 12, respectively. The lateral segment 32a was 150 mm long, and each of the longitudinal segments 32b was 50 mm long.

In receiving FM broadcast waves and TV broadcast waves, average gains (vs. standard dipole antenna) of the antennas of Examples 2 to 8 (shown in FIGS. 2 to 8, resepctively) were as shown in Table 2. For comparison, the average gains of the antenna of Example 1 (FIG. 1) are also shown in Table 2.

TABLE 2

| | Average Gain (dB) | | | |
|---|---|---|---|---|
| | FM Radio | | TV | |
| Antenna | 76-90 MHz | 88-108 MHz | VHF | UHF |
| Example 1 | −19.5 | −18.8 | −18.2 | −16.3 |
| Example 2 | −19.6 | −18.8 | −17.5 | −16.2 |
| Example 3 | −19.4 | −17.9 | −17.9 | −15.9 |
| Example 4 | −19.8 | −18.1 | −17.8 | −15.8 |
| Example 5 | −19.9 | −18.3 | −17.5 | −16.5 |
| Example 6 | −20.0 | −18.7 | −18.1 | −16.8 |
| Example 7 | −19.9 | −18.0 | −18.1 | −16.3 |
| Example 8 | −19.2 | −17.8 | −17.7 | −16.0 |

The data in Table 2 indicate that for the reception of either FM radio broadcast waves in the 88-108 MHz band or TV broadcast waves in the VHF or UHF band the efficiency of an antenna according to the invention can be enhanced by including an auxiliary antenna element of a relatively simple pattern.

It is optional to provide a vehicle roof glass with two (or more) antennas according to the invention in order to make diversity reception. In this option it is suitable to position one antenna on the right-hand side of the longitudinal center axis (C) of the vehicle body and another antenna on the left-hand side of the center axis. Also it is optional and rather favorable to constitute a diversity reception system by combining a roof glass antenna according to the invention with a different antenna such as a conventional pole antenna or an antenna on a window glass.

In the case of applying the invention to a vehicle roof glass using laminated glass, every element of the antenna may be formed of a thin metal wire or foil and embedded in the synthetic resin film(s) interposed between the two sheets of glass.

What is claimed is:

1. An antenna for receiving broadcast waves attached to a glass plate fitted in an opening along a lateral width of the roof of a vehicle body having a longitudinal center axis extending through a front end and a rear end of the vehicle body, the antenna comprising:

a main antenna element which is a conductive strip attached to the glass plate and bent so as to make a periphery of a closed plane rectangle and the main element has a total length in the range from 200 to 1500 mm, the main antenna element being shaped and arranged such that said longitudinal center axis of the vehicle body divides the main antenna element into two halves being symmetrical with respect to said longitudinal center axis and such that two relatively longer sides of the rectangle extend substantially parallel the longitudinal axis;

a feed point attached to the glass plate such that said longitudinal center axis intersects the feed point; and a connection line which connects said main antenna element to said feed point and extends substantially on said longitudinal center axis; and an auxiliary antenna element which is a conductive strip attached to the glass plate and directly connected to said main antenna element, said auxiliary antenna element being an at least partly L-shaped element.

2. An antenna according to claim 1, wherein said auxiliary antenna element is bent so as to make three sides of a rectangle.

3. An antenna according to claim 1, wherein said auxiliary antenna element is bent so as to make a rectangle with a gap in one side thereof.

4. An antenna according to claim 1, wherein the distance of said main antenna element from every edge of the glass plate is not shorter than 30 mm.

5. An antenna according to claim 1, wherein the total length of said main antenna element is in the range from 200 to 700 mm.

6. An antenna according to claim 1, wherein said vehicle body is an automobile body.

7. An antenna according to claim 2, wherein said rectangle of said auxiliary antenna element and said rectangle of said main antenna element are symmetrical with respect to said longitudinal center axis.

8. An antenna according to claim 3, wherein said auxiliary antenna element is arranged so as to surround said main antenna element.

9. An antenna for receiving broadcast waves attached to a glass plate fitted in an opening along a lateral width of the roof of a vehicle body having a longitudinal center axis extending through a front end and a rear end of the vehicle body, the antenna comprising:

a main antenna element which is a conductive strip attached to the glass plate and bent so as to make a periphery of a closed plane rectangle and the main element has a total length in the range from 200 to 1500 mm, the main antenna element being shaped and arranged such that said longitudinal center axis of the vehicle body divides the main antenna element into two halves being symmetrical with respect to said longitudinal center axis and such that two relatively longer sides of the rectangle extend substantially parallel the longitudinal axis;

a feed point attached to the glass plate such that said longitudinal center axis intersects the feed point; and a connection line which connects said main antenna element to said feed point and extends substantially on said longitudinal center axis; and an auxiliary antenna element which is a conductive strip attached to the glass plate and directly connected to said main antenna element, said auxiliary antenna element being an at least partly L-shaped element, said antenna further comprising another auxiliary antenna element which is a conductive strip attached to the glass plate and directly connected to said main element, said another auxiliary antenna element being an at least partly L-shaped element, said auxiliary antenna element and said another auxiliary antenna element being symmetrical in shape and arranged symmetrically with respect to said main antenna element.

10. An antenna according to claim 9, wherein each of said auxiliary antenna element and said another auxiliary antenna element is an entirely L-shaped element.

11. An antenna according to claim 9, wherein each of said auxiliary antenna element and said another auxiliary antenna element is bent so as to make three sides of a rectangle.

* * * * *